US010619321B2

(12) United States Patent
Hess et al.

(10) Patent No.: US 10,619,321 B2
(45) Date of Patent: Apr. 14, 2020

(54) APPARATUS, SYSTEM, AND METHOD FOR CLEANING AND MAINTAINING PILES

(71) Applicants: Whitehead Construction, Inc., Elizabethton, TN (US); The Sea Biscuit Group Inc, Johnson City, TN (US)

(72) Inventors: David T. Hess, Johnson City, TN (US); Michael D. Whitehead, Elizabethton, TN (US); R. Dale Bowling, Jr., Elizabethton, TN (US)

(73) Assignees: White Construction, Inc., Elizabethton, TN (US); The Sea Biscuit Group Inc., Johnson City, TN (US)

( * ) Notice: Subject to any disclaimer, the term of this patent is extended or adjusted under 35 U.S.C. 154(b) by 0 days.

(21) Appl. No.: 16/270,277

(22) Filed: Feb. 7, 2019

(65) Prior Publication Data

US 2019/0264409 A1 Aug. 29, 2019

Related U.S. Application Data

(60) Provisional application No. 62/636,465, filed on Feb. 28, 2018.

(51) Int. Cl.

| | |
|---|---|
| ***B08B 9/023*** | (2006.01) |
| ***E02B 17/00*** | (2006.01) |
| ***B05B 7/00*** | (2006.01) |
| ***B05B 1/28*** | (2006.01) |
| ***B05B 1/02*** | (2006.01) |

(52) U.S. Cl.

CPC ..... *E02B 17/0026* (2013.01); *B05B 1/02* (2013.01); *B05B 1/28* (2013.01); *B05B 7/0093* (2013.01); *B08B 9/023* (2013.01); *E02B 17/0034* (2013.01)

(58) Field of Classification Search

CPC ..... B08B 9/023

USPC ..... 405/211, 211.1, 212, 216; 134/172, 180, 134/199, 152; 15/104.04; 118/72, 306, 118/317, 323, DIG. 10

See application file for complete search history.

(56) References Cited

U.S. PATENT DOCUMENTS

| | | | |
|---|---|---|---|
| 1,134,881 | A | 4/1915 | Lockwood |
| 1,266,051 | A | 5/1918 | Reynolds |
| 1,680,372 | A | 8/1928 | Fenn |
| 2,960,706 | A | 11/1960 | Dunham |
| 3,734,048 | A | 5/1973 | Michaelsen |

(Continued)

FOREIGN PATENT DOCUMENTS

| | | |
|---|---|---|
| GB | 2358601 | 8/2001 |
| NL | 2016433 | 10/2017 |

*Primary Examiner* — Sunil Singh

(74) *Attorney, Agent, or Firm* — Pitts & Lake, P.C.

(57) ABSTRACT

A pile maintenance method, system, and apparatus including a shell configured to be opened and closed longitudinally such that the shell forms a chamber between a length of a pile and an inner surface of the shell when the shell is closed around the pile, at least one fixing member configured to fix the shell to the pile such that the shell is substantially centered on the pile, at least one sealing member provided proximate a bottom of the shell and configured to form a substantially watertight seal at a bottom of the chamber, a plurality of nozzles provided inside the shell and configured to spray one or more media onto the pile, and a drain outlet provided proximate the bottom of the shell and configured to drain contents from the chamber formed by the shell.

20 Claims, 17 Drawing Sheets

(56) References Cited

U.S. PATENT DOCUMENTS

| | | | |
|---|---|---|---|
| 4,064,702 | A | 12/1977 | Jansz |
| 4,136,419 | A | 1/1979 | Hetman et al. |
| 4,445,524 | A | 5/1984 | Angel |
| 4,502,407 | A | 3/1985 | Stevens |
| 4,689,523 | A | 8/1987 | Fowler |
| 4,809,381 | A | 3/1989 | Brandenburger et al. |
| 4,846,357 | A | 7/1989 | Sholl et al. |
| 4,895,205 | A | 1/1990 | Thompson et al. |
| 4,953,496 | A | 9/1990 | Taylor et al. |
| 4,991,996 | A | 2/1991 | Tate |
| 4,993,876 | A | 2/1991 | Snow et al. |
| 5,040,923 | A | 8/1991 | Do |
| 5,069,234 | A | 12/1991 | Nielson |
| 5,090,433 | A | 2/1992 | Kamaga |
| 5,136,969 | A | 8/1992 | Chapman |
| 5,361,791 | A | 11/1994 | Chapman et al. |
| 5,458,683 | A | 10/1995 | Taylor et al. |
| 5,520,734 | A | 5/1996 | Taylor et al. |
| 5,615,696 | A | 4/1997 | Lawler |
| 5,743,969 | A | 4/1998 | Lawler |
| 5,765,968 | A | 6/1998 | Lee |
| 6,023,807 | A | 2/2000 | Beissner |
| 6,371,696 | B1 | 4/2002 | Eathorne |
| 6,505,865 | B2 | 1/2003 | Minemyer |
| 7,018,138 | B2 | 3/2006 | Bae |
| 7,442,256 | B2 | 10/2008 | Sela et al. |
| 7,534,072 | B1 | 5/2009 | Scott |
| 8,465,228 | B2 | 6/2013 | Doleshal |
| 8,628,275 | B1 | 1/2014 | Trader et al. |
| 9,284,791 | B2 | 3/2016 | Angelle et al. |
| 9,382,682 | B2 | 7/2016 | Doleshal |
| 9,546,463 | B2 | 1/2017 | Do Nghia |
| 9,840,313 | B2 | 12/2017 | Cioanta et al. |
| 2004/0069331 | A1 | 4/2004 | Garman et al. |
| 2005/0163573 | A1* | 7/2005 | McMillan ..... B63B 21/502 405/211 |
| 2005/0266779 | A1* | 12/2005 | Skinner ..... B24C 1/08 451/91 |
| 2006/0042659 | A1 | 3/2006 | Fernandez et al. |
| 2012/0006554 | A1 | 1/2012 | Allen et al. |
| 2014/0158171 | A1 | 6/2014 | Doleshal |

* cited by examiner

APPARATUS, SYSTEM, AND METHOD FOR CLEANING AND MAINTAINING PILES

CROSS-REFERENCE TO RELATED APPLICATIONS

This application claims the benefit of U.S. Provisional Patent Application Ser. No. 62/636,465, filed on Feb. 28, 2018, which is incorporated herein in its entirety by reference.

FIELD OF INVENTION

The present general inventive concept relates to maintenance of water platform piles, and, more particularly, to a system and method to clean and maintain the platform piles.

BACKGROUND

Many structures built and/or residing over bodies of water are supported on columns commonly referred to as platform piles, or simply piles. Certain portions of these piles are subjected on a daily basis to alternating states of being submerged under water, such as when the tide is high, and being exposed above water, such as when the tide is low. These constant changes in environmental conditions causes the pile to have areas of severe corrosion in the areas affected by the tidal change. Due to the nature of the above water arrangement, even routine cleaning of the affected areas can be problematic. Conventional methods of combatting this problem include installing a sheath around the pile to guard against corrosion. However, such a solution is problematic in that it is difficult and expensive to apply to each pile, and may be prone to further rotting of the pile if liquid gets between the sheath and the pile and becomes trapped therein. Thus, there exists a need for a way to clean the damaged pile areas in a more convenient manner, as well as a way help prevent or at least reduce future corrosion and other damage.

BRIEF SUMMARY

According to various example embodiments of the present general inventive concept, an apparatus, method, and system is provided to clean and protect areas of water platform piles from corrosion due to tidal change. The apparatus includes a shell that can be closed around the pile to form a sealed chamber from which water can be drained, and media sprayers inside the shell to spray cleaning and/or sealing agents onto the pile.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a pile maintenance apparatus including a shell configured to be opened and closed longitudinally such that the shell forms a chamber between a length of a pile and an inner surface of the shell when the shell is closed around the pile, at least one fixing member configured to fix the shell to the pile such that the shell is substantially centered on the pile, at least one sealing member provided proximate a bottom of the shell and configured to form a substantially watertight seal at a bottom of the chamber, a plurality of nozzles provided inside the shell and configured to spray one or more media onto the pile, and a drain outlet provided proximate the bottom of the shell and configured to drain contents from the chamber formed by the shell.

The foregoing and/or other aspects and advantages of the present general inventive concept may also be achieved by providing a method of performing maintenance on a pile, the method including closing a shell around a predetermined portion of a pile such that the shell forms a chamber between a length of the pile and inner surface of the shell, fixing the shell to the pile with at least one fixing member configured to substantially center the shell on the pile, sealing the shell with at least one sealing member proximate a bottom of the shell to form a substantially watertight seal at a bottom of the chamber, draining content of the shell through a drain outlet provided proximate the bottom of the shell, and spraying one or more media onto the pile with a plurality of nozzles provided inside the shell.

The foregoing and/or other aspects and advantages of the present general inventive concept may also be achieved by providing a pile maintenance system including a pile maintenance apparatus having a shell configured to be opened and closed longitudinally such that the shell forms a chamber between a length of a pile and an inner surface of the shell when the shell is closed around the pile, at least one fixing member configured to fix the shell to the pile such that the shell is substantially centered on the pile, at least one sealing member provided proximate a bottom of the shell and configured to form a substantially watertight seal at a bottom of the chamber, a plurality of nozzles provided inside the shell and configured to spray one or more media onto the pile, and a drain outlet provided proximate the bottom of the shell and configured to drain contents from the chamber formed by the shell, and a mechanical arm configured to be coupled to an outer surface of the shell and to move and to articulate opening and closing of the shell.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
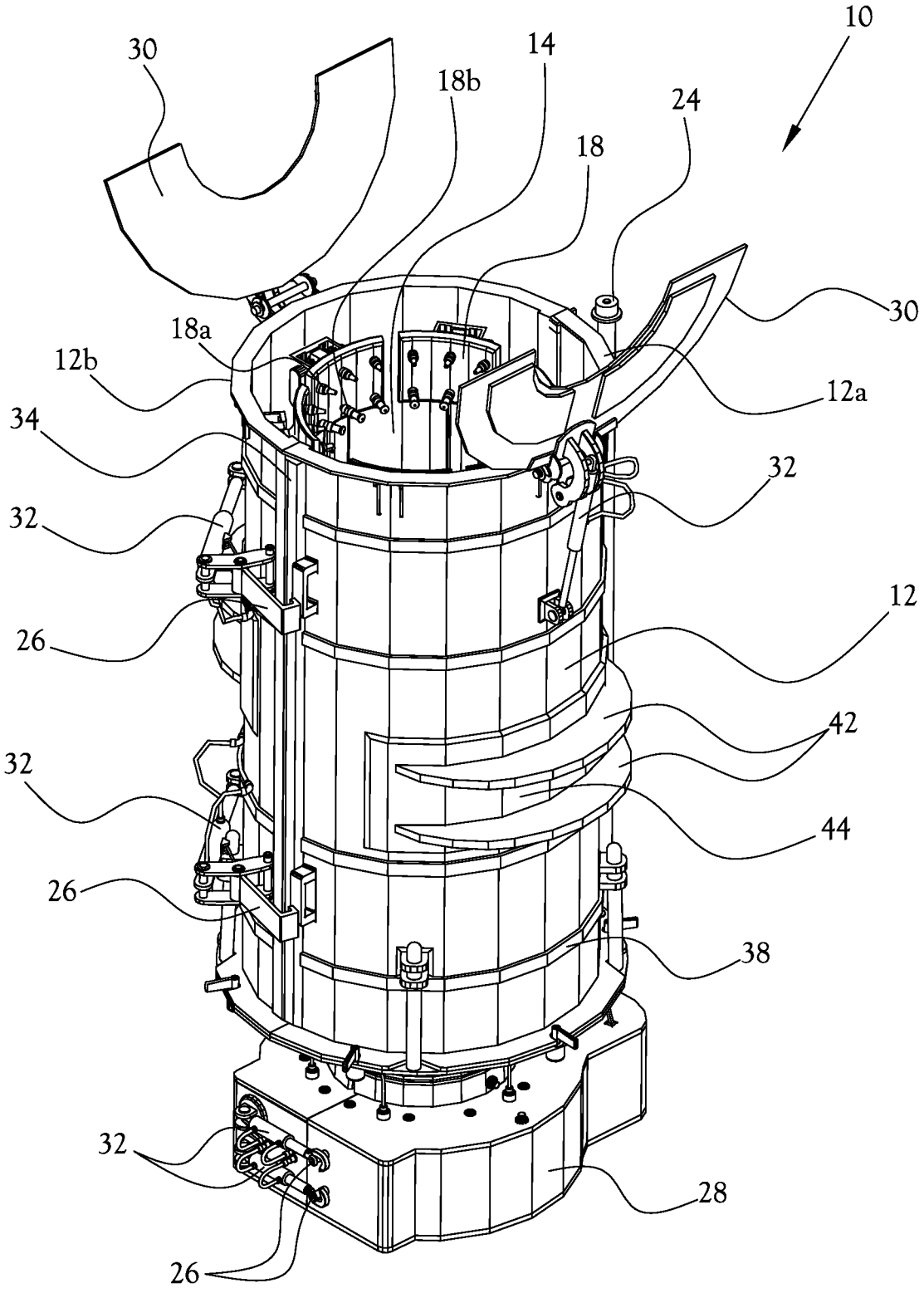
FIG. 1 illustrates a closed position of a pile maintenance apparatus according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, an apparatus, method, and system is provided to clean and protect areas of water platform piles from corrosion due to tidal change. One example embodiment of the present general inventive concept provides a cleaning apparatus that can be affixed to and operated at the end of a mechanical arm such as that of a crane provided on a work barge used to perform cleaning, maintenance, etc., on an oil rig platform. Example embodiments of the present general inventive concept described herein may be referred to as a pile maintenance apparatus, and may be used for cleaning and/or providing protective coatings to piles, especially at areas exposed by tidal changes. According to various example embodiments of the present general inventive concept, the pile maintenance apparatus may be formed in two longitudinal sections such that the apparatus may be opened to place the two longitudinal sections at opposite sides of a pile, and then closed together around the pile to form a cleaning and/or sealing operation on the pile. In various example embodiments, the two longitudinal sections of the apparatus may be coupled together by a hinge member. Thus, the pile maintenance apparatus may be moved from an open position to a closed position, and vice versa.

Figure 2:
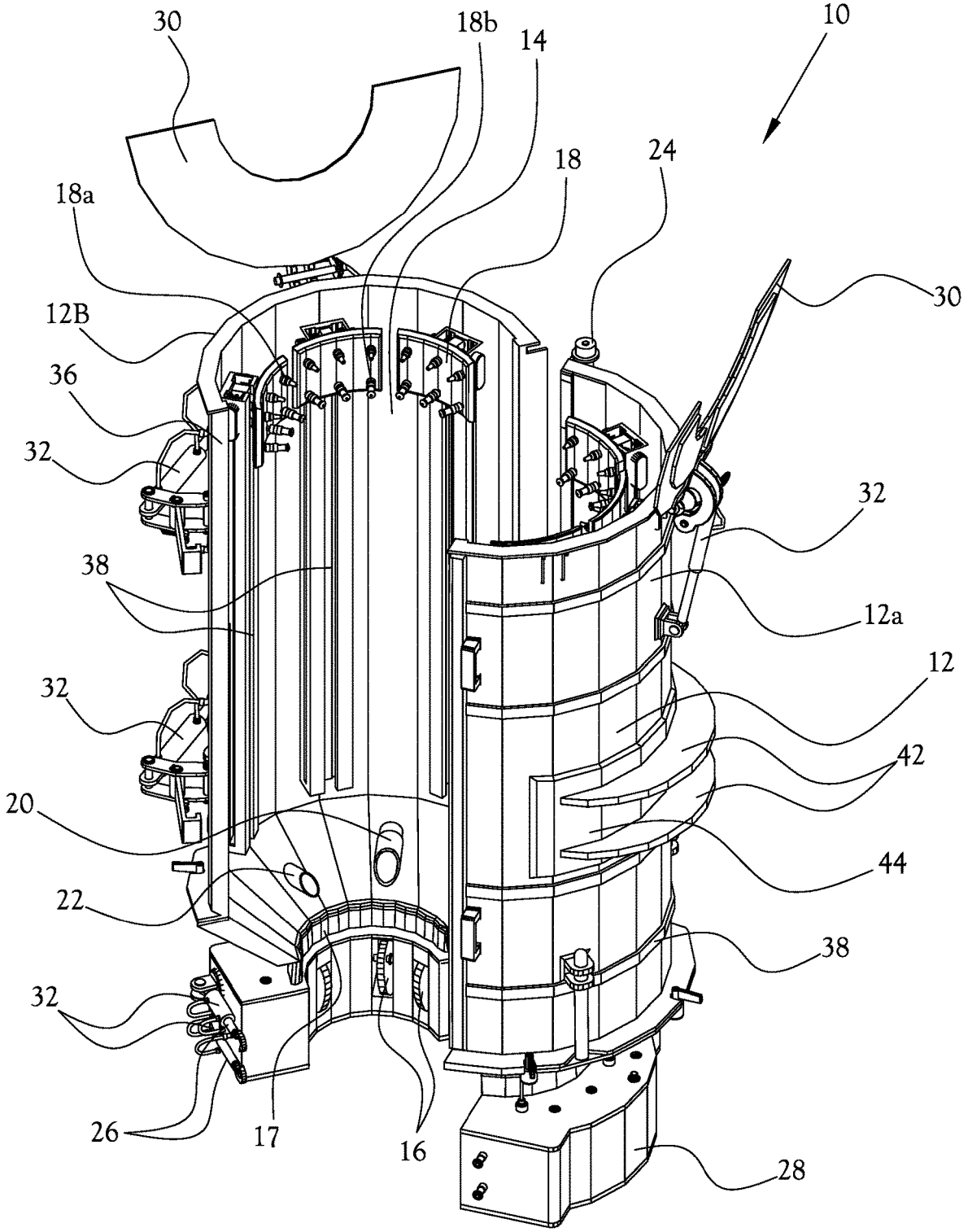
FIG. 2 illustrates an open position of the pile maintenance apparatus of FIG. 1.

FIG. 1 illustrates a closed position of a pile maintenance apparatus according to an example embodiment of the present general inventive concept, and FIG. 2 illustrates an open position of the pile maintenance apparatus of FIG. 1. As illustrated in the example embodiment of FIGS. 1-2, the pile maintenance apparatus 10 includes a shell 12 that is constructed so as to be opened and closed longitudinally such that the shell 12 forms a chamber 14 between a length of a pile and an inner surface of the shell 12 when the shell 12 is closed around a pile. The shell 12 illustrated in FIGS. 1-2 is formed in two halves 12A,12B that are coupled to one another by a hinge member 24 so as to be opened to place around a pile, and to be closed around the pile to form the chamber 14 which will be the pile cleaning and sealing workspace. As illustrated in FIG. 1, two seams 34 will be formed on substantially opposite sides of the shell 12 when in the closed position, and a sealing gasket 36 may be provided along at least one of the longitudinal edges forming each seam 34 to provide a substantially watertight seal at the seams 34. At least one fixing member may be provided to fix, and center, the shell 12 on the pile. In the example embodiment illustrated in FIGS. 1-2, a plurality of fixing members are provided as alternating cams 16 located in a base 28 of the apparatus 10. Thus, when the shell 12 is closed around the pile, the alternating cams 16 are rotated so as to extend outwardly from the base 28 and contact the pile to fix the shell in place, and substantially centered on the pile. Various example embodiments of the present general inventive concept may provide any of a number of other types of fixing members, and may be located at different points, such as the top, of the apparatus 12. One or more latching members 26 may be provided to the apparatus 10 to secure the shell 12 in a closed position. In the example embodiment illustrated in FIGS. 1-2, two latches 26 are provided along the body of the shell 12, and two latches 26 are provided on the base 28. In this example embodiment, the latches 26 are automatically actuating latches operated by hydraulic controls 32, but other example embodiments may employ a host of different types of latching members or controls, such as, for example, spring-loaded latches and/or latches driven by electric motors. In various example embodiments, the latches 26 may only be provided along the seam 34 on the opposite side of the shell 12 from the hinge member 24, as the coupling of the shell sections 12A,12B by the hinge member 24 may provide enough pressure on the hinge member 24 side to avoid needing such latching. The apparatus 10 of FIGS. 1-2 is also provided with lid portions 30 which are also driven by hydraulic controls 32 to at least partially close a top opening of the shell 12 when the shell 12 is in the closed position. Various example embodiments may include sealing members to form a watertight seal at areas closed by the lid portions 30. Also, various example embodiments of the present general inventive concept may not include such lid portions 30 at all, as the cleaning and sealing operations will not be greatly affected by an open portion of the shell 12. However, some example embodiments will be provided with such lids to keep any water spray, wildlife, etc., out of the chamber during a cleaning and/or sealing operation. As illustrated in FIG. 2, the apparatus 10 is provided with at least one sealing member provided proximate a bottom of the shell 12 to form a substantially watertight seal at a bottom of the chamber 14. In this example embodiment, the sealing member is an inflatable bladder 17 provided to both shell sections 12A, 12B just above the base 28. After the apparatus 10 is fixed to the pile, the inflatable bladders 17 are inflated so as to press against a surface of the pile to provide a watertight bottom to the chamber 14. Various example embodiments may include different or additional sealing members to provide a substantially watertight bottom to the chamber 14. A drain outlet 20 is provided near the bottom of the chamber 14 to drain any liquid and other particles out of the chamber 14 during cleaning and sealing operations, which will be discussed in more detail herein. Similarly, an inlet port 22 is provided near the bottom of the chamber 14 to flood the chamber 14 with liquid from outside the apparatus 10 during rinsing operations, and after all of the cleaning and/or sealing operations are completed so that the shell 12 may be more easily opened. In the example embodiment of the present general inventive concept illustrated in FIGS. 1-2, the bottom of the shell 12 is tapered inward leading to the base 28, but various other example embodiments may employ a host of different configurations.

As illustrated in FIGS. 1-2, a plurality of nozzles 18 are provided inside the shell 12 to spray one or more media onto the pile. Various different example embodiments of the present general inventive concept may provide different numbers or configurations of nozzles 18 to provide substantially even coverage of the surface of the pile along the length enclosed by the shell 12. In this example embodiment illustrated in FIGS. 1-2, the nozzles 18 are provided in a top row 18A and a bottom row 18B. The nozzles 18 are positioned such that substantially equal spacing is achieved around a circumference of in inner surface of the chamber 14, so that the combined spray from the nozzles 18 will be substantially equally applied around a circumference of the pile. In this example embodiment, the nozzles 18 are configured to be moved up and down in the chamber 14 to provide a sprayed media along most of the longitudinal surface of the pile located in the shell 12. The nozzles 18 are attached to sliding members 40 which are respectively coupled to rails 38 that run along a length of the chamber 14. Thus, by motorized control (by electric motors, hydraulics, etc.) the sliding members 40 move up and down along the respective rails 38 to spray media in substantially equal coverage along the length of the pile located in the shell 12. The sliding members 40 are formed in an arcuate shape such that the nozzles 18 fixed to the sliding members 40 are maintained at a substantially equal distance from a longitudinal center of the shell 12 during up and down movement. Each of the sliding members 40 are provided with a plurality of nozzles 18 from both the top row 18A and the bottom row 18B. In the example embodiment illustrated in FIGS. 1-2, the top row 18*a* of nozzles 18 are configured to spray at least a first cleaning spray to clean an outer surface of the pile, and the bottom row 18B of nozzles 18 are configured to spray at least a sealing substance to seal the outer surface of the pile. In the descriptions herein, the sealing substance is urethane, but various other example embodiments may use other sealing materials in place of, or in addition to, urethane. In this example embodiment, the top row 18A of nozzles 18 are also configured to spray compressed air to dry the outer surface of the pile.

The example embodiment illustrated in FIGS. 1-2 also includes a plurality of coupling members 42 provided at substantially opposite sides of the shell 12 to be coupled to a mechanical arm which may be used to move the apparatus 10 and to articulate the opening and closing of the shell 12. In this example embodiment, the coupling members 42 include a pair of protrusions on opposite sides of the shell 12 to form a receiving portion 44 to receive a gripping member of the mechanical arm, such as a claw at the end of a crane. The coupling members may provide the coupling by simple contact above and below the gripping members of the mechanical arm, or may also have through holes that align with corresponding through holes in the gripping members to receive bolts to more securely couple the apparatus 10 to the mechanical arm. An example embodiment employing the apparatus 10 with a mechanical arm is described herein. In various example embodiments, the apparatus may be located around the pile by hand. In such example embodiments, the operations of the apparatus 10 may be controlled by an on-board processor, or by a processor in wired or wireless electrical communication with the apparatus. In various example embodiments, the media delivered by the nozzles may be stored in on-board reservoirs (not illustrated), or may be delivered through hoses connected to other sources. Such hoses may be run along a mechanical arm to a service barge or other such arrangement.

Figure 3:
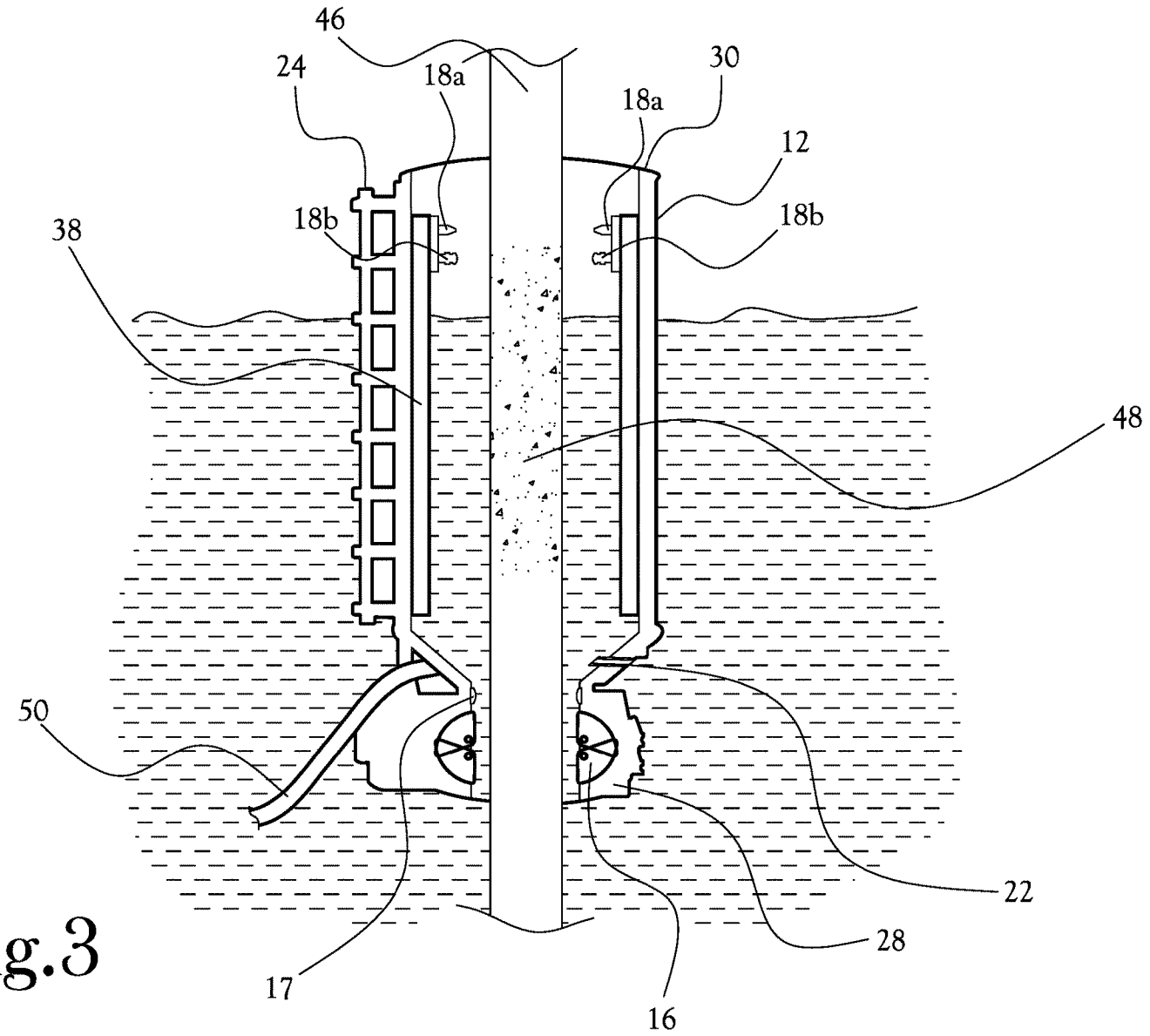
FIG. 3 illustrates a pile maintenance apparatus closed about a pile according to an example embodiment of the present general inventive concept.

Some of the various cleaning and sealing operations that may be performed with the present general inventive concept will be described in FIGS. 3-15. FIG. 3 illustrates a pile maintenance apparatus closed about a pile according to an example embodiment of the present general inventive concept. As illustrated in FIG. 3, the apparatus 10 has been closed about a length of a pile 46, and is full of liquid captured in the chamber 14 during the closing of the shell 12. As illustrated, the shell 12 has been essentially centered on the corrosion 48 formed on the pile 46 by the tidal changes, such that the nozzles 18 can provide substantially complete coverage along the corrosion 48 area. The lid portions 30 are shown as already closed for the sake of simplicity and clarity.

Figure 4:
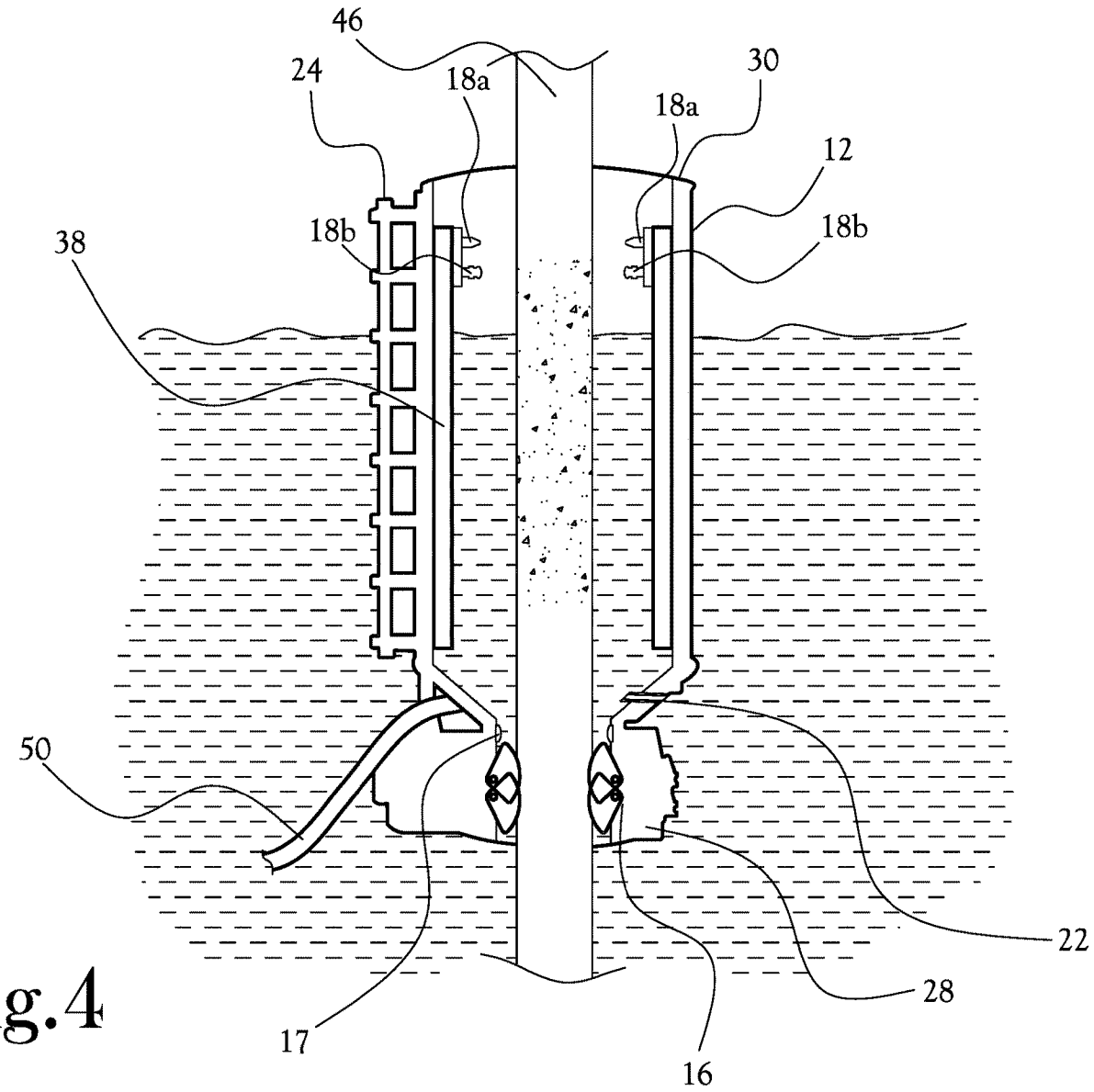
FIG. 4 illustrates the pile maintenance apparatus of FIG. 3 with fixing members fixing the pile maintenance apparatus to the pile.

FIG. 4 illustrates the pile maintenance apparatus of FIG. 3 with fixing members fixing the pile maintenance apparatus to the pile. As illustrated in FIG. 4, the alternating cams 16 have been rotated to extend from the base 28 to the pile 46 to fix the apparatus 10 in place, and to substantially center the shell 12 about the pile 46. Various example embodiments of the present general inventive concept may have different numbers and/or types of fixing members, and which may be placed at different locations along the pile.

Figure 5:
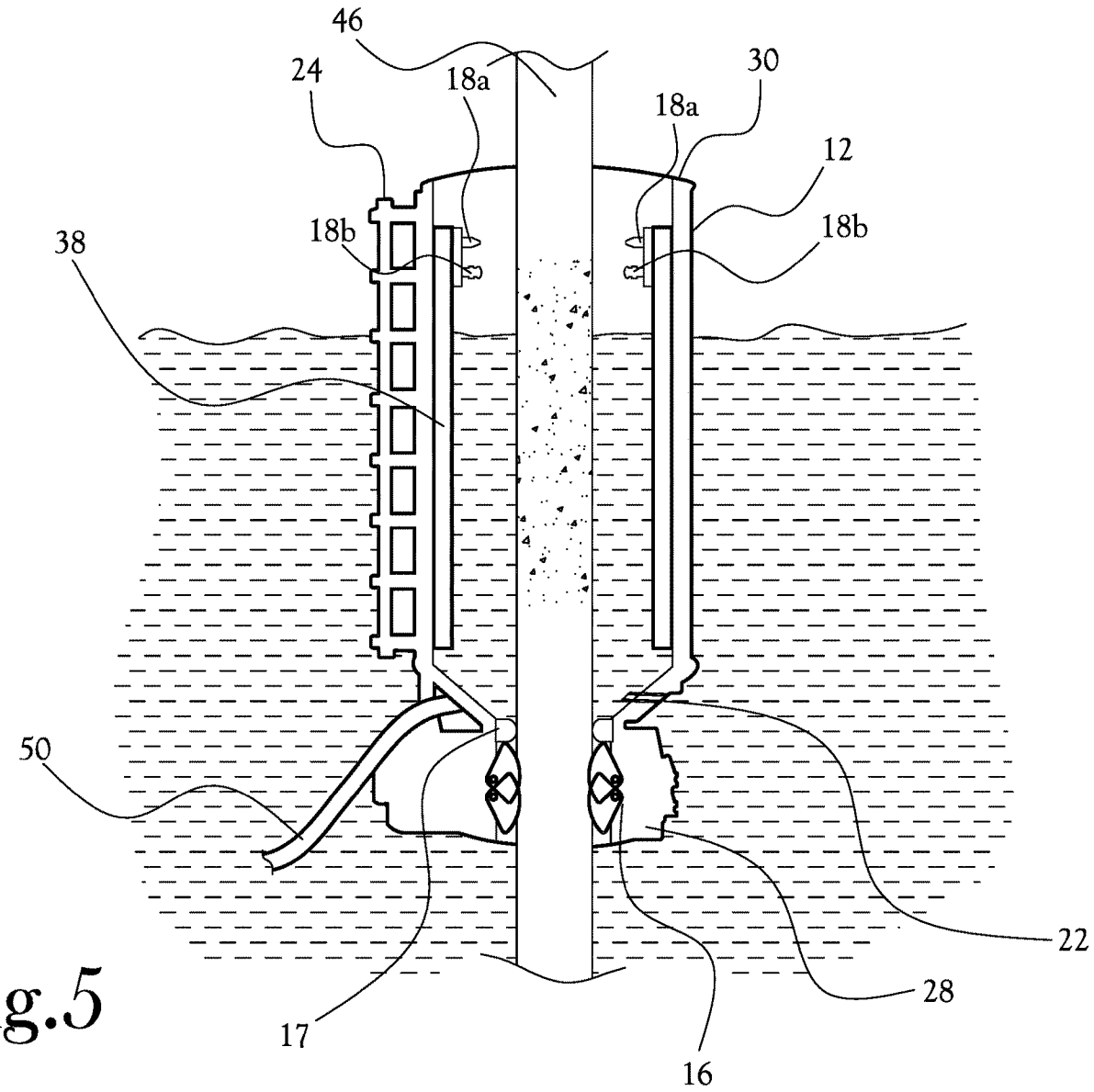
FIG. 5 illustrates the pile maintenance apparatus of FIG. 3 with a sealing member forming a seal at a bottom of a chamber formed by the pile maintenance apparatus.

FIG. 5 illustrates the pile maintenance apparatus of FIG. 4 with a sealing member forming a seal at a bottom of a chamber formed by the pile maintenance apparatus. As illustrated in FIG. 5, the inflatable bladders 17 provided to each section 12A,12B of the shell 12 are inflated to form a substantially watertight seal at the bottom of the chamber 14. Various example embodiments of the present general inventive concept may provide types of sealing members, which may be utilized in different configurations to provide the watertight seal.

Figure 6:
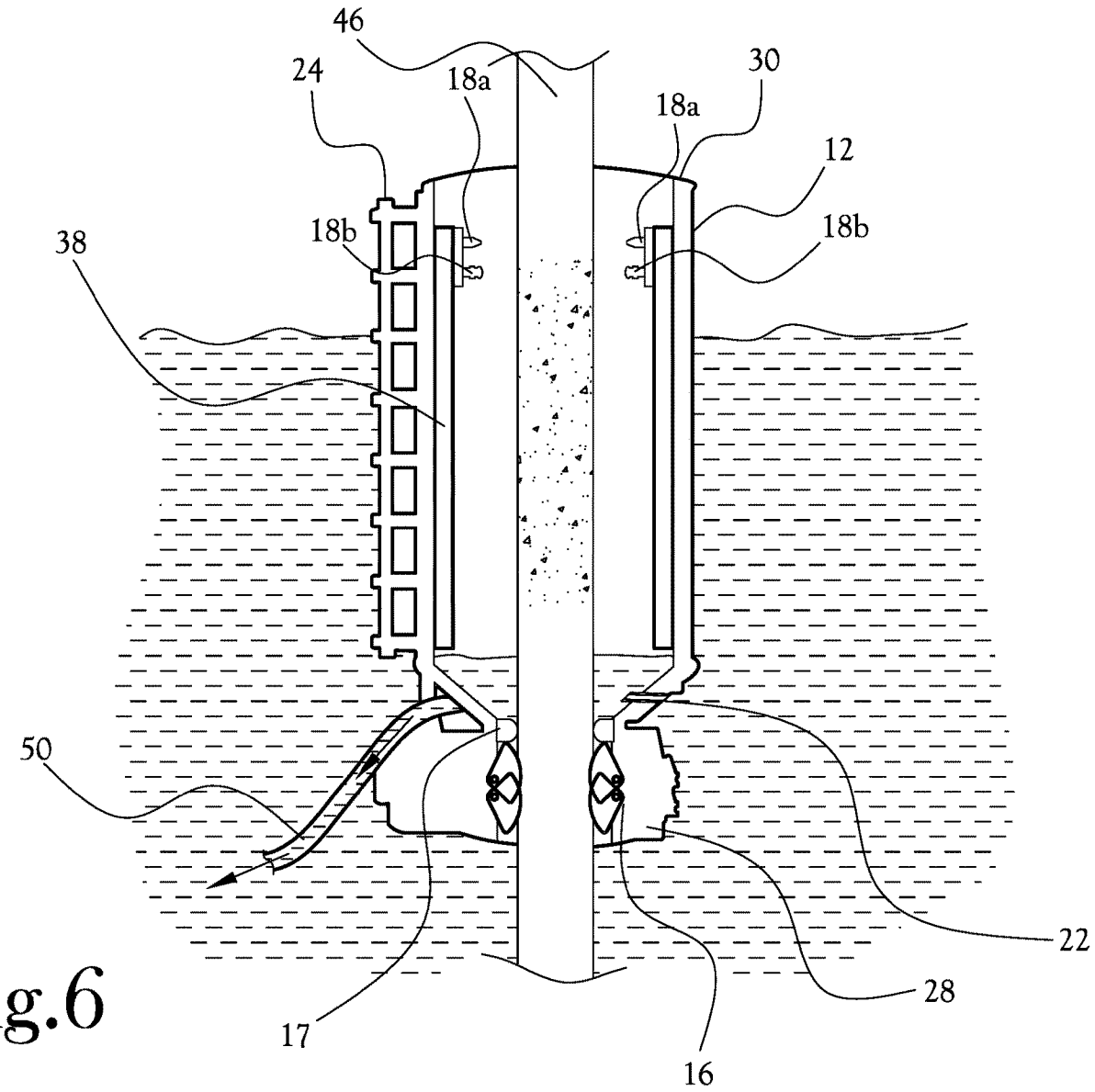
FIG. 6 illustrates the pile maintenance apparatus of FIG. 3 with the content of the chamber being drained out of the chamber.

FIG. 6 illustrates the pile maintenance apparatus of FIG. 5 with the content of the chamber being drained out of the chamber. As illustrated in FIG. 6, now that the chamber 14 has been sealed at the bottom, a valve associated with the drain outlet 20 has been opened to drain the liquid from the chamber 14 through a drain hose 50 which may be configured to drain all contents from the chamber 14 to tank or other such reservoir, so that no contaminants used in the cleaning and sealing operations are released into the water around apparatus 10.

Figure 7:
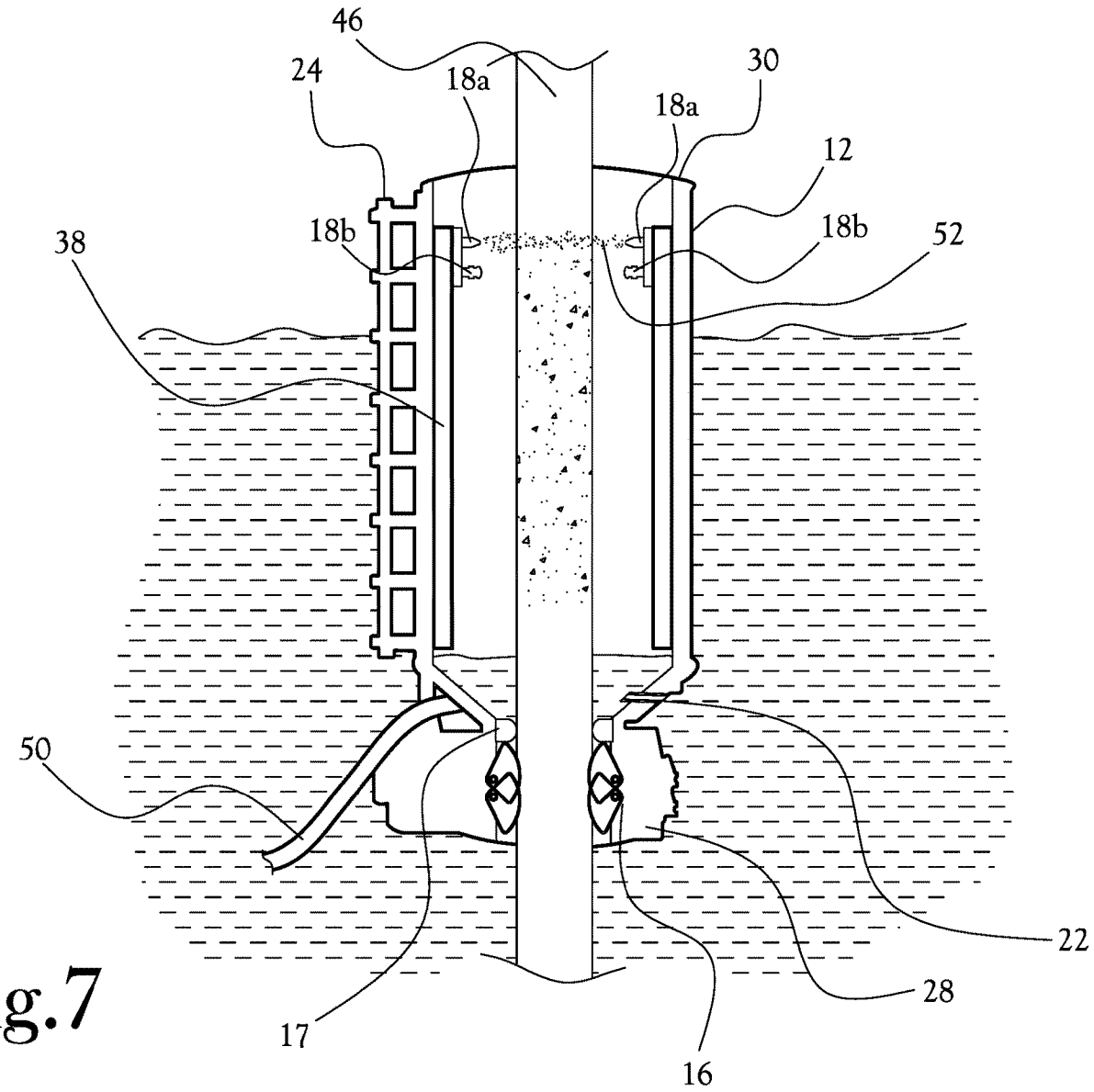
FIGS. 7-8 illustrate the pile maintenance apparatus of FIG. 3 performing a cleaning operation on the pile.
Figure 8:
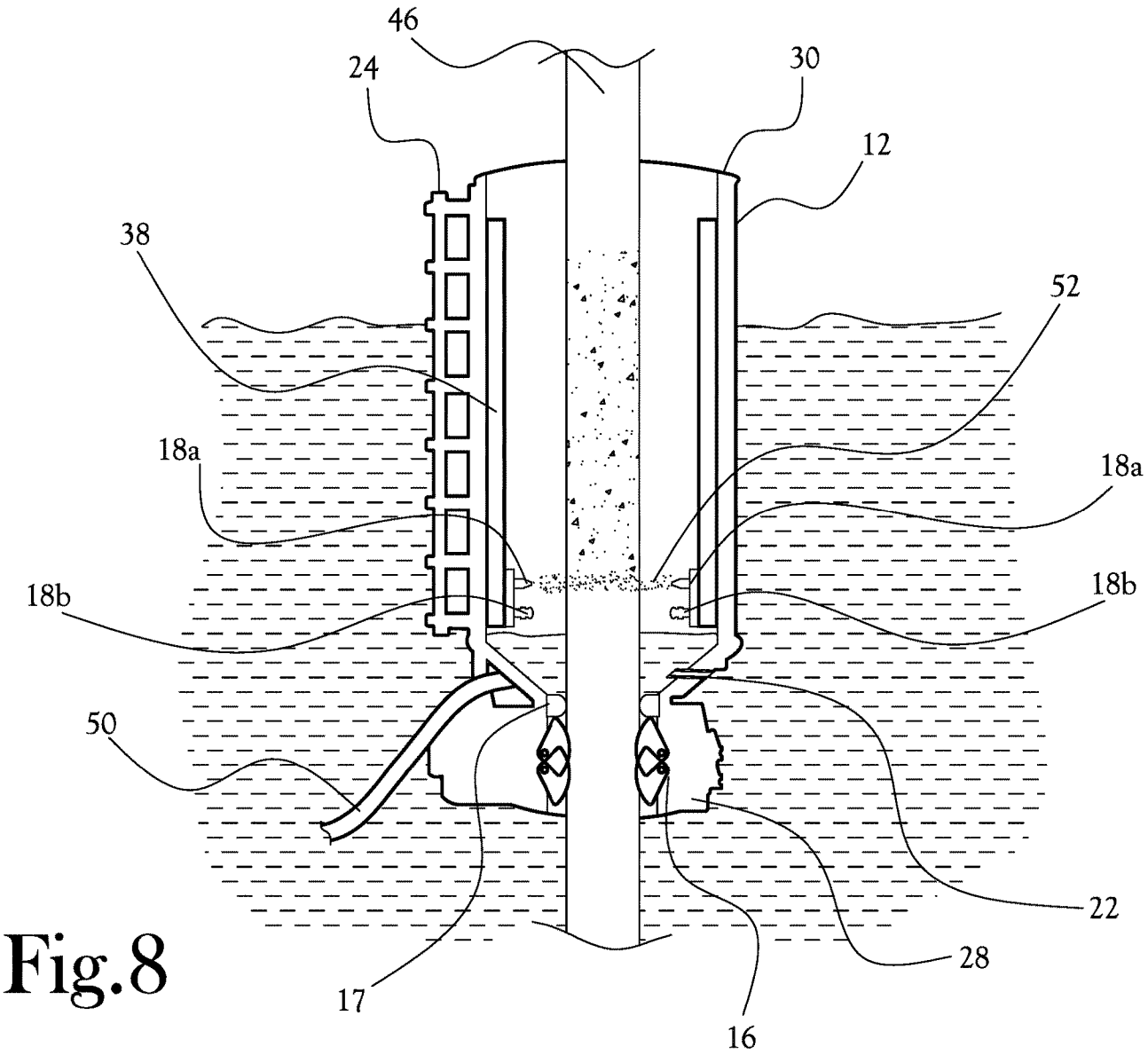

FIGS. 7-8 illustrate the pile maintenance apparatus of FIG. 6 performing a cleaning operation on the pile. As illustrated in FIG. 7, now that the liquid has been cleared from the chamber 14, the top row 18A of nozzles spray one or more cleaning media 52 onto the pile to remove the corrosion and other undesirable materials from the surface of the pile 46. The sliding members 40 move down the rails 38 to a point near the bottom of the chamber 14, thereby moving the nozzles 18, as illustrated in FIG. 8, and then move back to a top of the rails 38. The nozzles 18 in the top row 18A may spray the cleaning media 52 in both directions.

Figure 9:
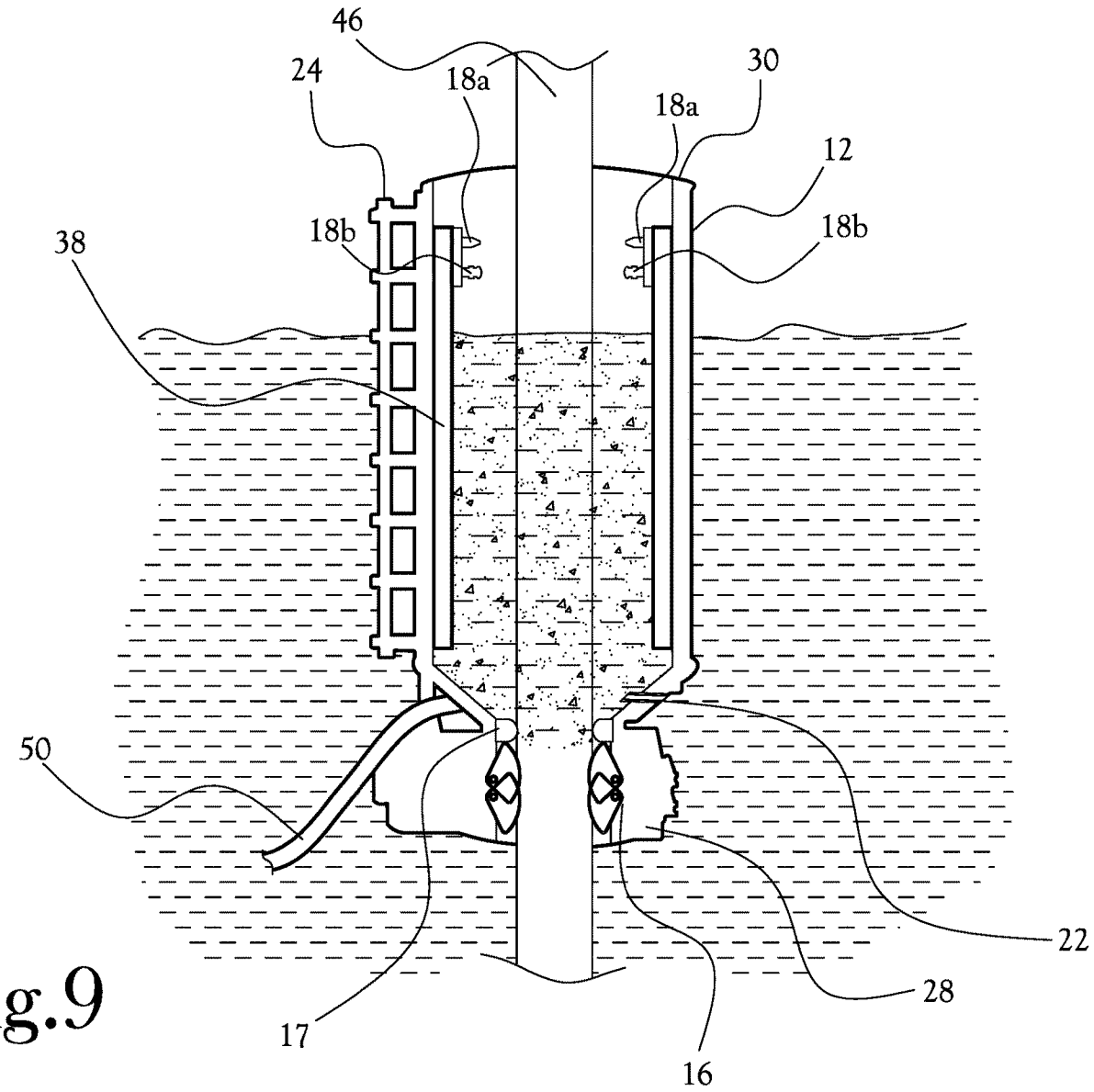
FIGS. 9-10 illustrate the pile maintenance apparatus of FIG. 3 performing a rinsing operation in the chamber.
Figure 10:
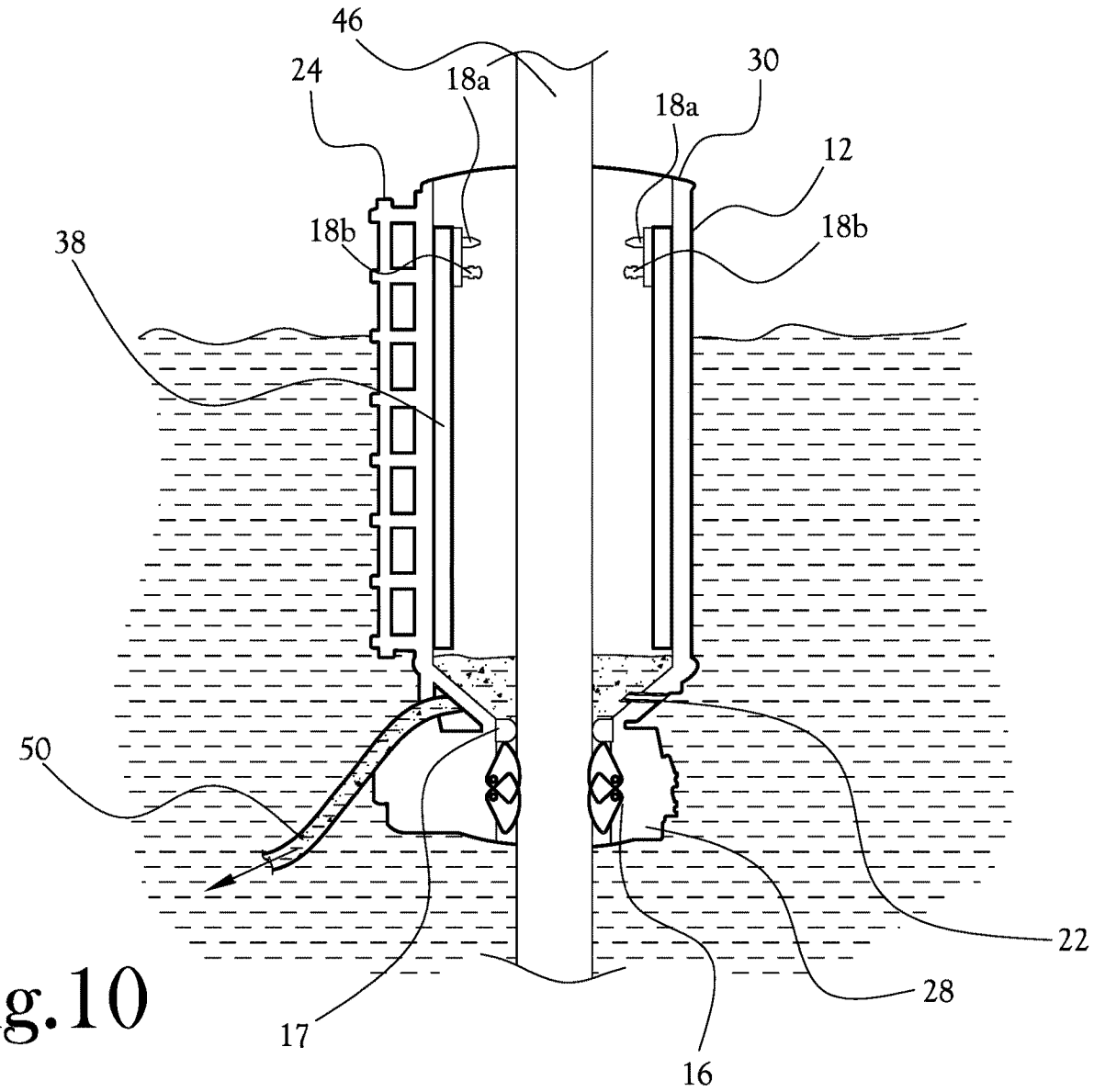

FIGS. 9-10 illustrate the pile maintenance apparatus of FIGS. 7-8 performing a rinsing operation in the chamber. As illustrated in FIG. 9, after the cleaning media 52 has been sprayed on the pile 46, a valve associated with the inlet port 22 is opened to allow liquid from outside the apparatus 10 to flow into the chamber 14 to rinse the surface of the pile 46. In FIG. 10, the inlet port has been closed 22, and the rinse liquid and particles therein are drained out of the chamber 14 through the drain hose 50.

Figure 11:
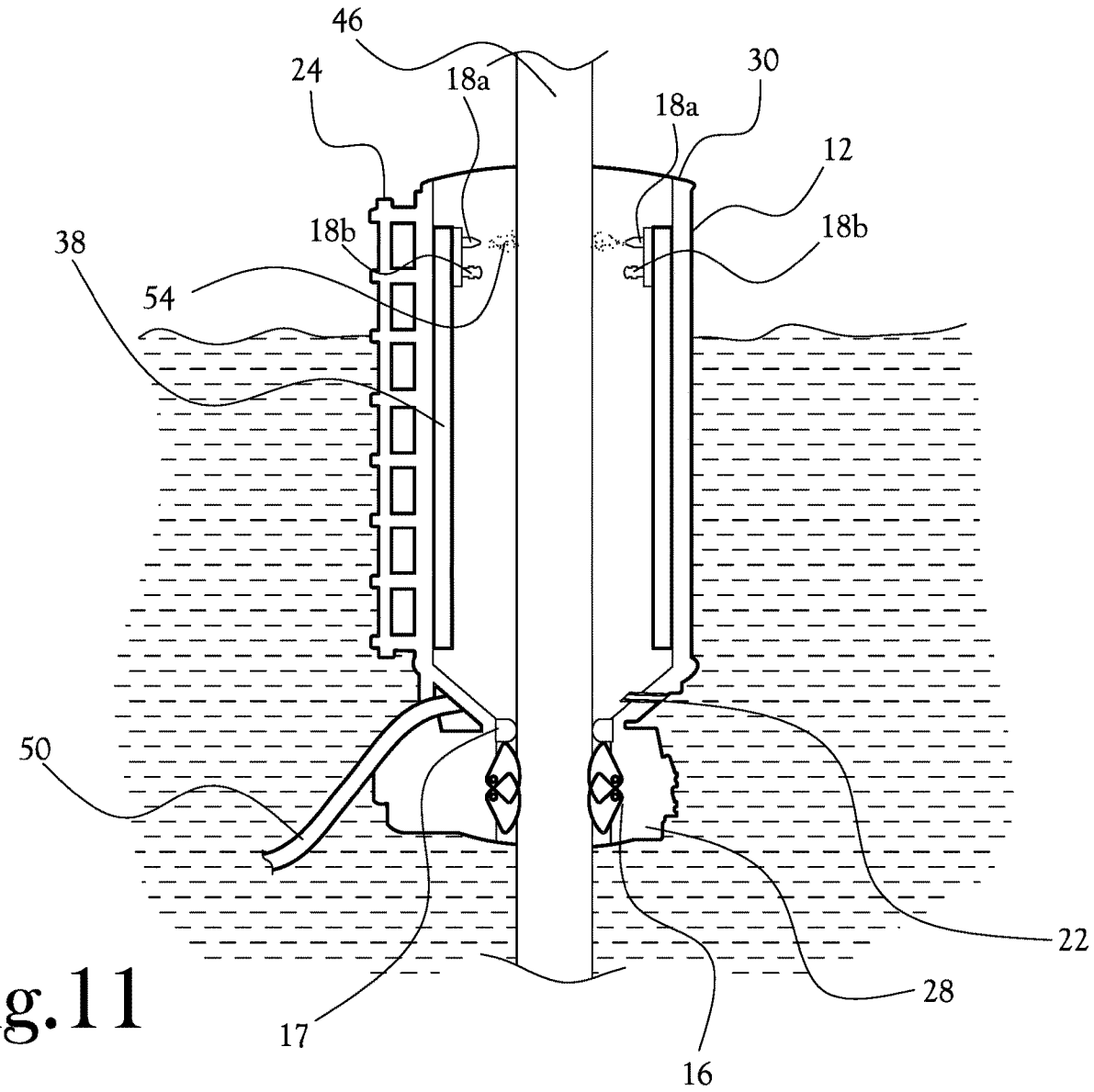
FIGS. 11-12 illustrate the pile maintenance apparatus of FIG. 3 performing a drying operation on the pile.
Figure 12:
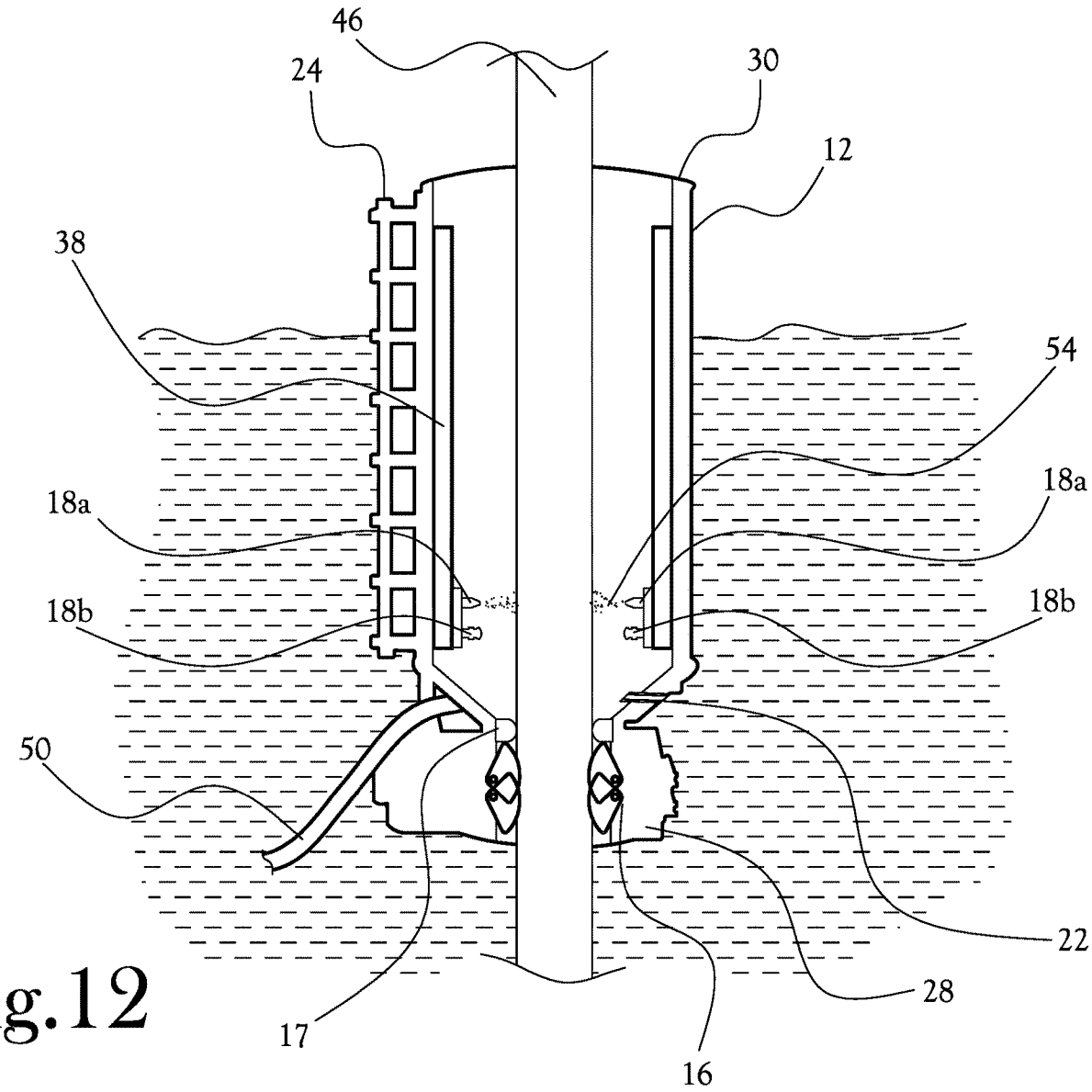

FIGS. 11-12 illustrate the pile maintenance apparatus of FIGS. 9-10 performing a drying operation on the pile. As illustrated in FIGS. 11-12, the nozzles 18 in the top row 18A spray pressurized air 54 while moving up and down along the pile 46 to dry the surface of the pile. Although this example embodiment illustrates the media spray nozzles 18 in the top row 18A being used to spray the pressurized air 54, various different example embodiments may use more nozzles that are dedicated to spraying pressurized air, or nozzles that are each used for all of the cleaning, drying, and sealing operations.

Figure 13:
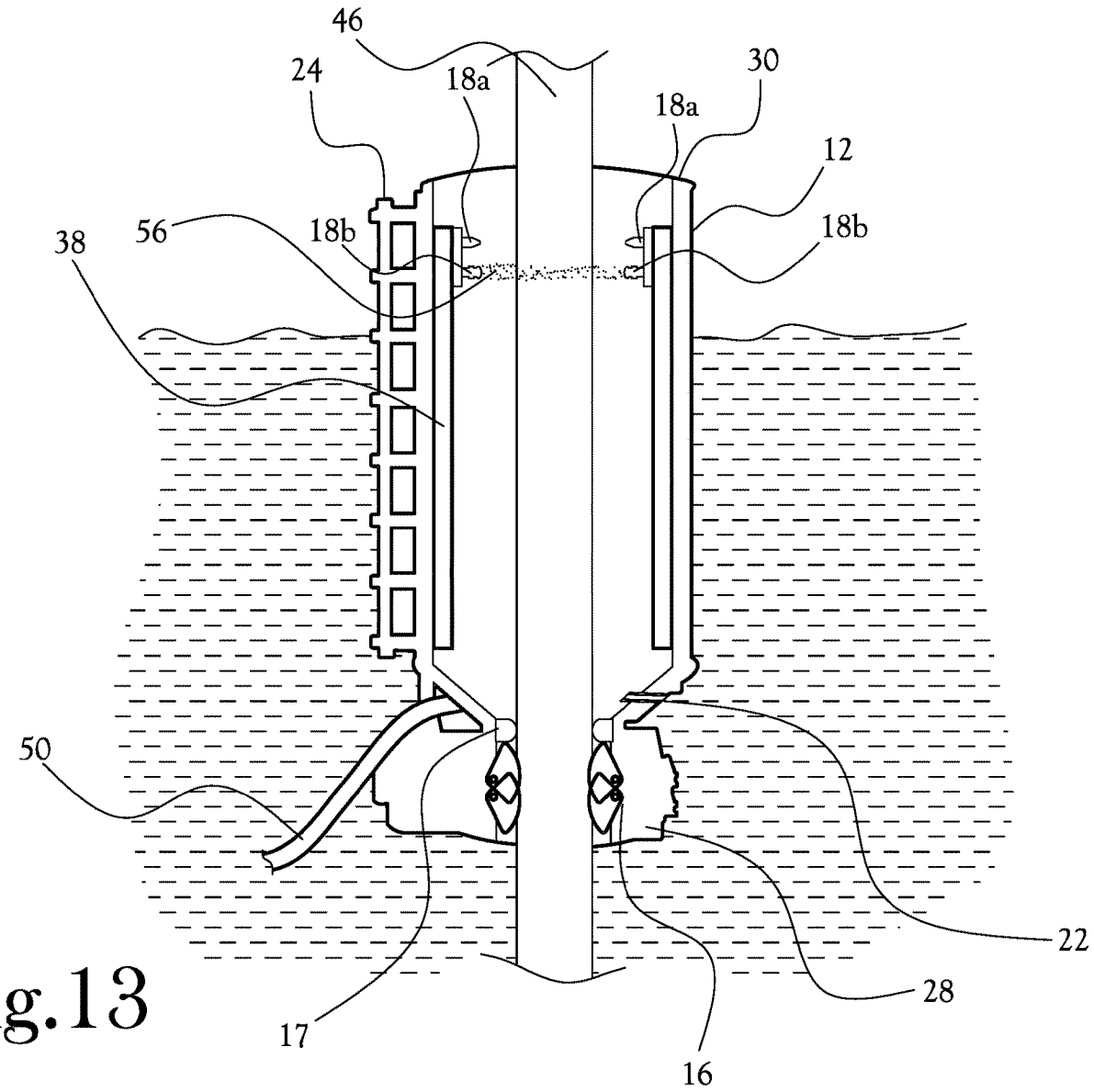
FIGS. 13-14 illustrate the pile maintenance apparatus of FIG. 3 performing a sealing operation on the pile.
Figure 14:
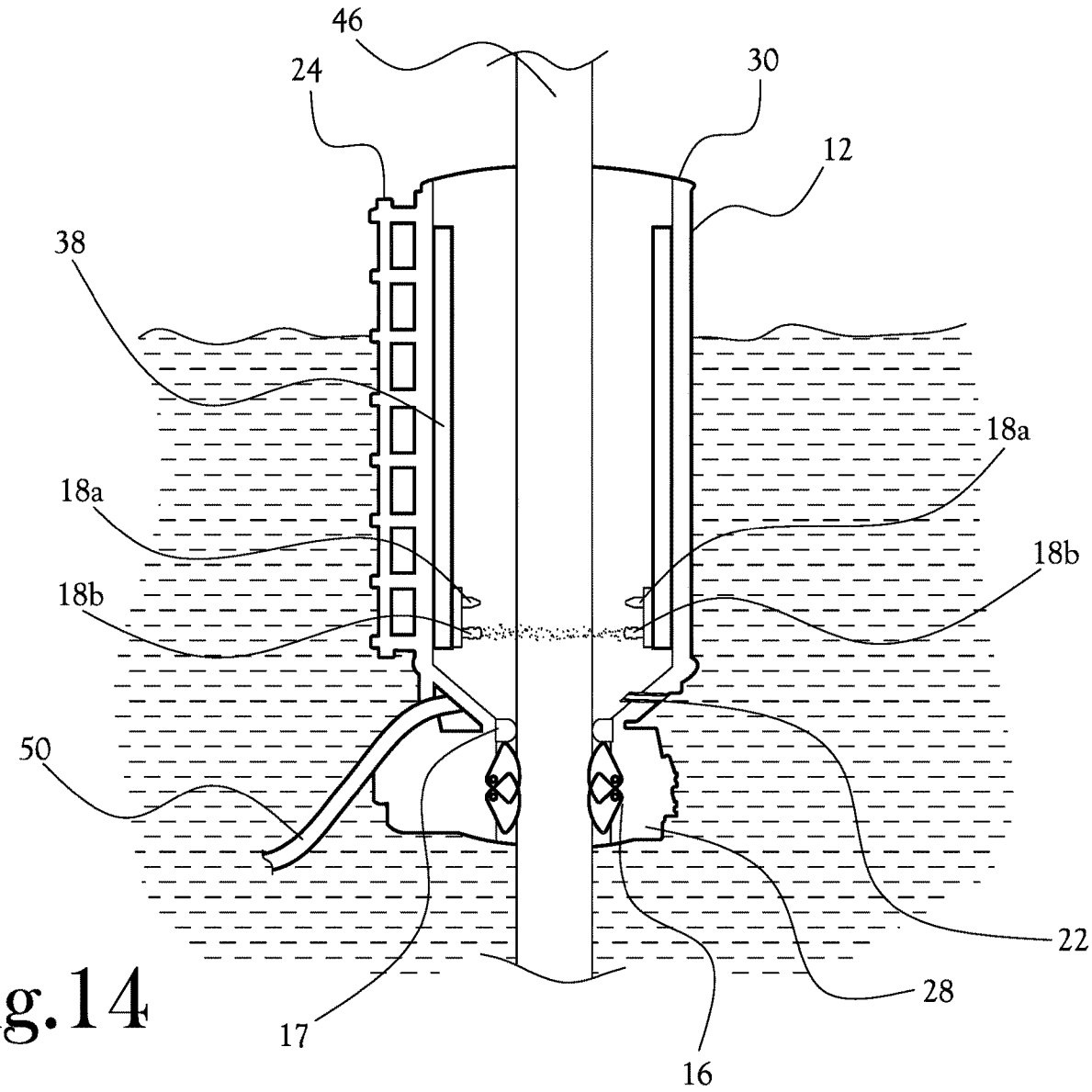

FIGS. 13-14 illustrate the pile maintenance apparatus of FIG. 11-12 performing a sealing operation on the pile. As illustrated in FIGS. 13-14, the nozzles 18 in the bottom row 18B spray a sealant 56 while moving up and down along the pile 46 to seal the surface of the pile. In various example embodiments of the present general inventive concept, the sealant 56 sprayed onto the pile 46 is urethane.

Figure 15:
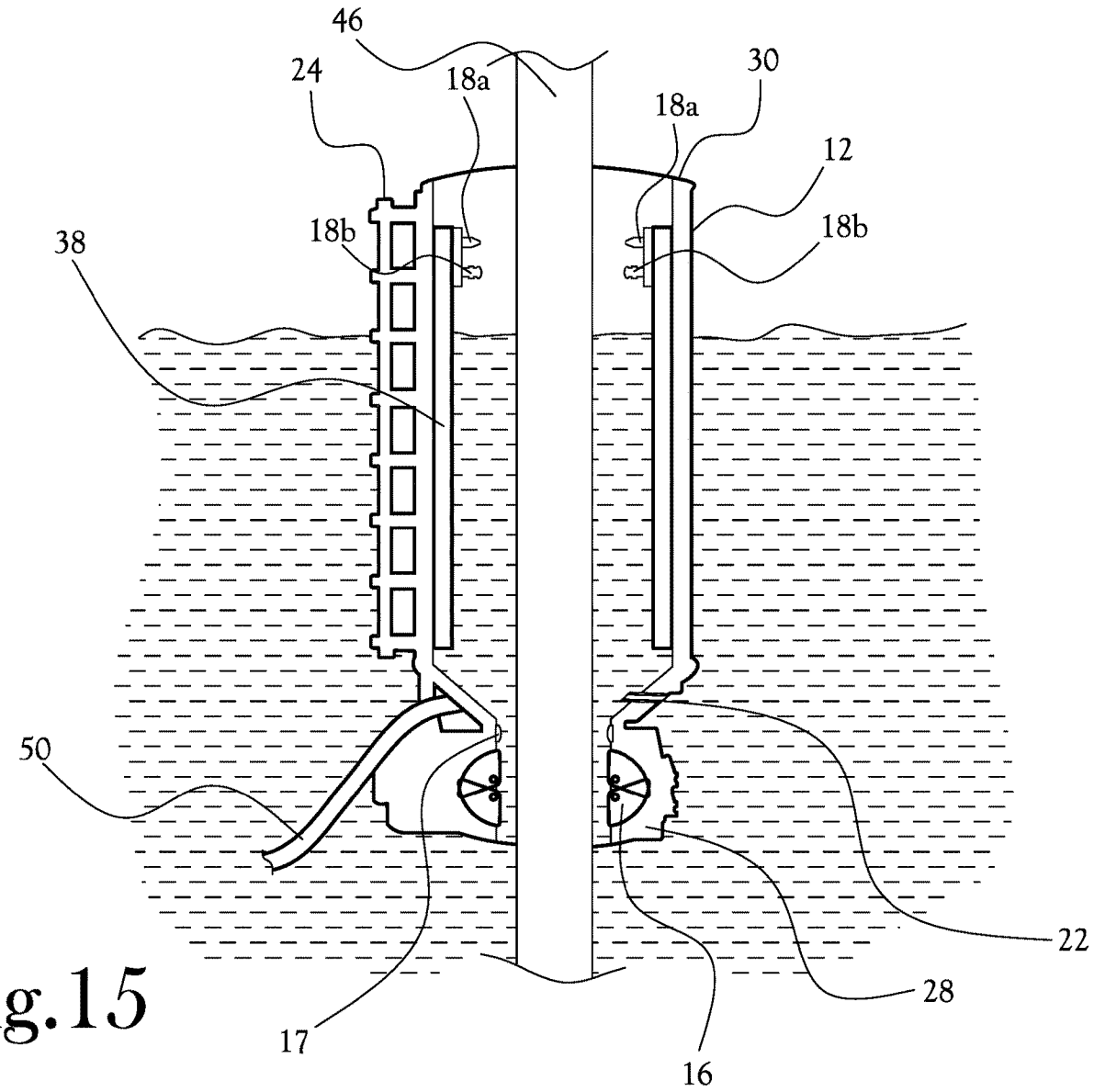
FIG. 15 illustrates the pile maintenance apparatus of FIG. 3 being flooded and prepared to be detached from the pile.

FIG. 15 illustrates the pile maintenance apparatus of FIGS. 13-14 being flooded and prepared to be detached from the pile. After the sealant 56 has been allowed to dry on the surface of the pile 46, the chamber 14 is flooded, the inflatable bladders 17 are deflated, and the alternating cams 16 are withdrawn so that the apparatus 10 may be opened and removed from the pile 46, leaving a pile that has been cleaned and sealed so that corrosion may be prevented for an extended length of time.

Figure 16:
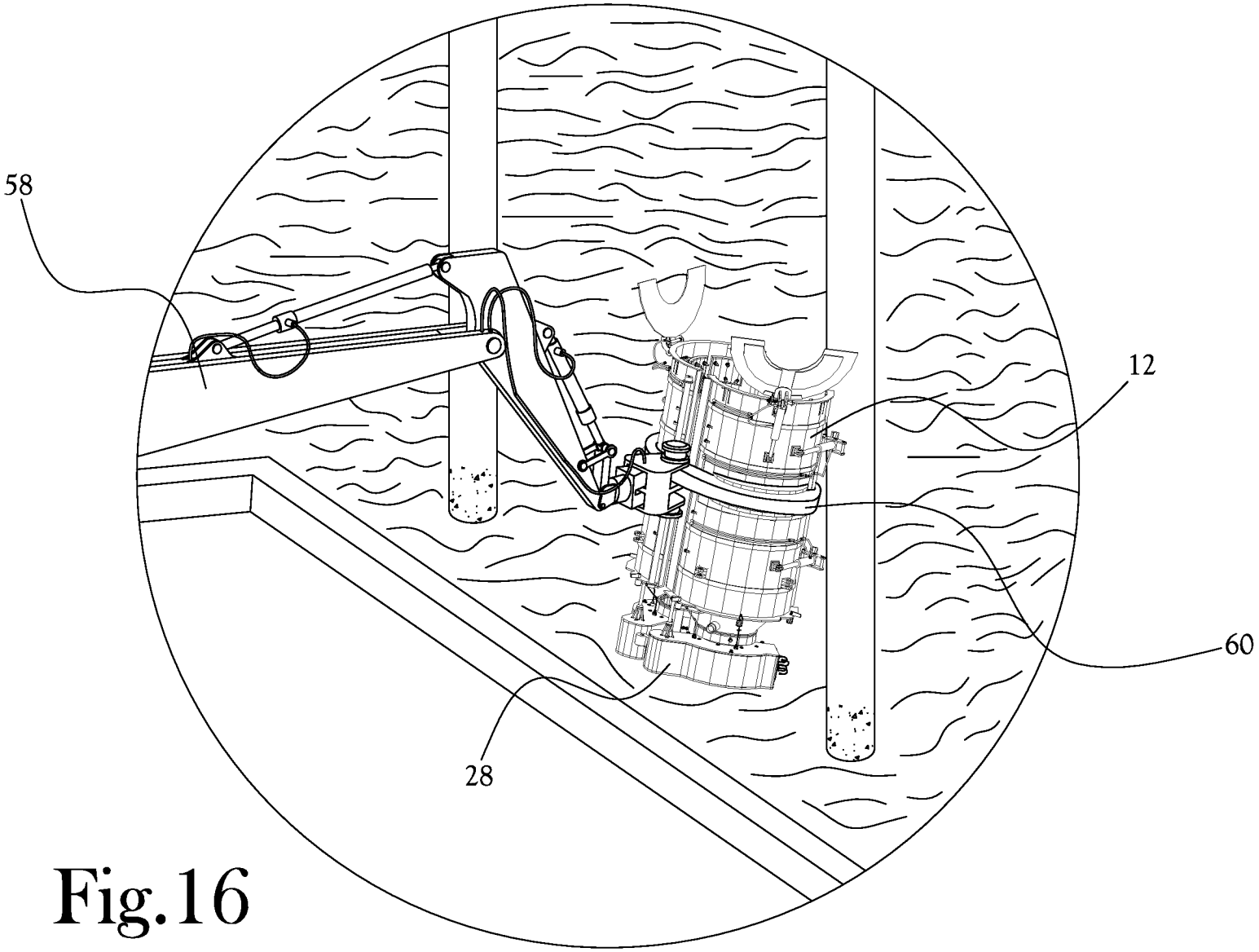
FIG. 16 illustrates a pile maintenance system according to an example embodiment of the present general inventive concept.

As previously described, various example embodiments of the pile maintenance apparatus 10 may be configured to be coupled to an articulating claw type of device at the end of a crane arm or other such mechanical arm to form a pile maintenance system to be used in situation such as, for example, operating the pile maintenance apparatus from a service barge. FIG. 16 illustrates a pile maintenance system according to an example embodiment of the present general inventive concept. The pile maintenance apparatus 10 may be formed overall in a substantially cylindrical configuration relative to the diameter of a common pile size. According to various example embodiments of the present general inventive concept, an inner cylindrical surface of the pile maintenance apparatus may be sized to maintain a predetermined distance between the pile and the inner cylindrical surface when the apparatus is placed around the pile, so as to form the chamber 14 about the pile 46. The outer surface of the pile maintenance apparatus 10 may be provided with the coupling members or portions 42 that extend from the outer surface to couple with the claw of the mechanical arm 58, or crane arm. In the example embodiment illustrated in FIG. 16, two such coupling portions 42 extend from each side of the apparatus 10 in a direction perpendicular to the longitudinal axis of the apparatus 10. The coupling portions 42 are further configured to be coupled at the top and bottom of the gripping portion of the claw arm, such that the claw can be received between the respective side coupling portions 42 and abut against the outer surface of the apparatus 10 in between the coupling portions 42. The coupling portions 42 may be provided with through holes to receive bolts to secure the coupling arrangement, and the bolts may be automatically extended from the crane claw into the through holes. Such a coupling arrangement secures the pile maintenance apparatus 10 to the claw, as movement is prevented in any direction due to the contact between the surfaces in the coupling arrangement.

As illustrated in FIG. 16, the crane may pick up the pile maintenance apparatus 10 and move toward the edge of the work barge proximate the pile to be maintained. As previously described, the pile maintenance apparatus 10 may be bifurcated with two longitudinal seams 34 opposite one another, the two sections 12A,12B being coupled together in a hinged arrangement at an outer surface proximate one of the seams. As such, the two halves of the apparatus 10 may be separated in an articulating manner to move around the pile, and to be closed around the pile. The pile maintenance apparatus 10 may be configured with a height that substantially covers the area of the pile affected by the tidal changes, so that the apparatus 10 only has to be placed around each pile in one place. A waste or drain hose 50 is attached to the apparatus, such as, for example, proximate a bottom portion of the apparatus 10, to remove any waste produced by the maintenance procedure rather than having the waste introduced to the water.

After the crane opens the pile maintenance apparatus 10 and situates the apparatus around the area of the pile to be maintained, the claw closes the apparatus 10 back to the form of a cylinder. Various example embodiments of the apparatus may be provided with members to lock the apparatus such that the apparatus is closed around the outer cylindrical surface. In the example embodiment illustrated in FIG. 16, the base 28 of the apparatus 10 is provided with hydraulic securing members 26 at the base and along the shell 12 that hook into corresponding receiving portions along the outer surface and pull the securing arrangement tight to form a seal. The securing members 26 may pivot in multiple directions before engaging the hook arrangements, and then may shorten in length to provide the tight seal.

The inner surface of the shell 12 is provided with the plurality of longitudinal rails 38 that are configured such that maintenance attachments coupled to the longitudinal rails 38 can move up and down the inner surface of the shell 12 to access an entirety of the length of pile encased by the pile maintenance apparatus 10. The maintenance attachments may be attached to sliding and reciprocating curved members that are configured between the respective rails 38 and maintenance attachments to provide more proximate coverage to around the entire circumference of the pile. In various example embodiments of the present general inventive concept, one type of maintenance attachments coupled to the sliding members may be media sprayers that blast away the corrosion and unwanted substances that have collected on the surface of the pile. In various example embodiments, the media sprayed by the media sprayers is environmentally friendly and reusable. When the blasting of the pile by the media sprayers is complete, the main tank may be re-flooded through a separate port to rinse any remaining loose media or detritus from the pile. The rinse water and collected waste is then drained through the aforementioned waste hose. After the rinse water is drained off, the surface of the pile may be dried by high pressure air nozzles attached to the sliding members. Supply lines may supply the media sprayers and air nozzles from compartments provided to the apparatus, or from other supplies located on the crane or work barge and transmitted to the apparatus through hose connections. After the surface of the pile inside the main tank has been properly cleaned, dried, and freed of loose debris, the media sprayers may be employed to spray a coat of a protective substance, such as, for example, urethane, to guard the pile against natural corrosion and/or wear for years to come. After the new protective coat has dried, the main tank is flooded, and the apparatus is removed from the pile.

Figure 17:
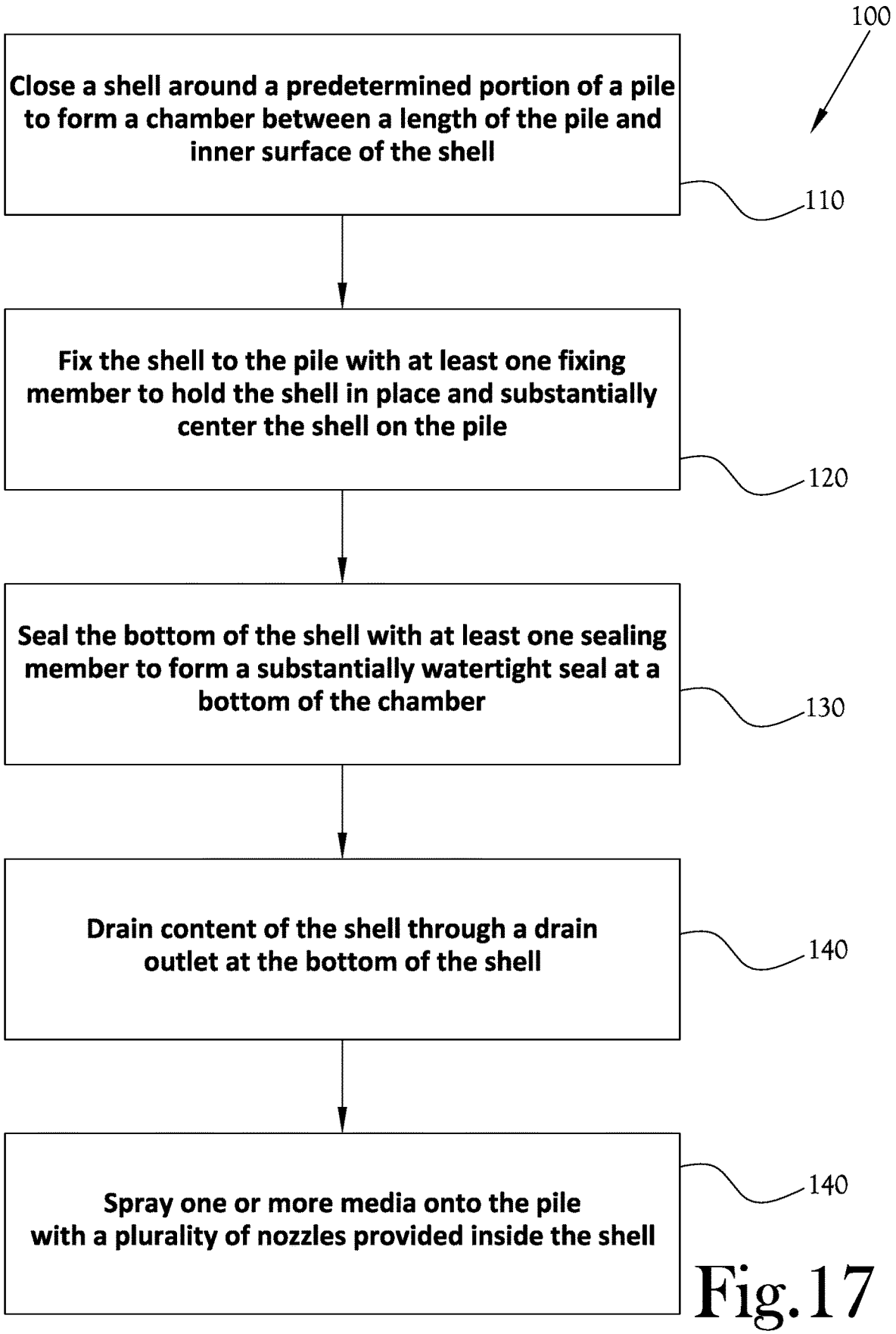
FIG. 17 illustrates a method of performing maintenance on a pile according to an example embodiment of the present general inventive concept.

FIG. 17 illustrates a method of performing maintenance on a pile according to an example embodiment of the present general inventive concept. In operation 100, the shell of the apparatus is closed around a predetermined portion of a pile to form a chamber between a length of the pile and inner surface of the shell. In operation 110, the shell is fixed to the pile with at least one fixing member to hold the shell in place and substantially center the shell on the pile. In operation 120, the bottom of the shell is sealed with at least one sealing member to form a substantially watertight seal at a bottom of the chamber. In operation 130, the liquid and other contents trapped inside the chamber by the closing of the shell is drained from the chamber through a drain outlet at the bottom of the shell. In operation 140, one or more media is sprayed onto the pile with a plurality of nozzles provided inside the shell.

Thus, various example embodiments of the present general inventive concept provide a pile maintenance apparatus, system, and method that creates much improvement in performance and convenience when treating water platform piles. Various example embodiments may be automated such that the operations are performed easily using a mechanical arm from a service barge, and results in an aesthetically pleasing and structurally sound seal to guard against future corrosion of the pile.

Various example embodiments of the present general inventive concept may provide a pile maintenance apparatus including a shell configured to be opened and closed longitudinally such that the shell forms a chamber between a length of a pile and an inner surface of the shell when the shell is closed around the pile, at least one fixing member configured to fix the shell to the pile such that the shell is substantially centered on the pile, at least one sealing member provided proximate a bottom of the shell and configured to form a substantially watertight seal at a bottom of the chamber, a plurality of nozzles provided inside the shell and configured to spray one or more media onto the pile, and a drain outlet provided proximate the bottom of the shell and configured to drain contents from the chamber formed by the shell. The shell may be formed as two sections configured to be in register with one another at respective first and second longitudinal seams when closed, and may further include at least one hinge member coupling the two sections of the shell together proximate the first longitudinal seam, wherein the two sections of the shell may pivot about the at least one hinge member during opening and closing of the shell. The pile maintenance apparatus may further include at least one latching member provided proximate the second longitudinal seam and configured to secure the two sections of the shell in a closed position. The at least one latching member may be configured as an automatically actuating latch. The pile maintenance apparatus may further include at least one gasket provided along each of the first and second longitudinal seams to form a substantially watertight seal. The plurality of nozzles may be configured in a circle about the inner surface of the shell and to spray the one or more media in a direction toward a longitudinal center of the shell so as to spray the one or more media about a circumference of the pile. The pile maintenance apparatus may further include a plurality of rails provided longitudinally along the inner surface of the shell, wherein the plurality of nozzles may be configured to be moved up and down along the rails to spray the one or more media along the length of the pile in the chamber. The pile maintenance apparatus may further include a plurality of sliding members respectively coupled to the rails and configured to be moved up and down along the rails, wherein two or more of the plurality of nozzles may be fixed to each of the sliding members, and the sliding members may be formed in an arcuate shape such that the plurality of nozzles fixed thereto are maintained at a substantially equal distance from a longitudinal center of the shell. The two or more of the plurality of nozzles fixed to each of the sliding members may be respectively provided in a top row and a bottom row, one of the top or bottom rows of nozzles may be configured to spray at least a first cleaning spray to clean an outer surface of the pile, and another of the top or bottom rows of nozzles may be configured to spray at least a sealing substance to seal the outer surface of the pile. The sealing substance may be urethane. At least one of the top or bottom rows of nozzles may be configured to also spray compressed air to dry the outer surface of the pile. The pile maintenance apparatus may further include a base provided at the bottom of the shell, wherein the at least one fixing member may be provided in the base. The at least one fixing member may include a plurality of cams configured to be rotatable so as to extend from the base and contact the pile. The at least one sealing member may include a plurality of air bladders configured to inflate after a closing of the shell to interact with the pile and each other to form the substantially watertight seal at the bottom of the chamber. The pile maintenance apparatus may further include a plurality of lid portions configured to at least partially close a top of the shell when the shell is closed. The pile maintenance apparatus may further include an intake port configured to pass liquid located outside the shell into the chamber.

Various example embodiments of the present general inventive concept may provide a method of performing maintenance on a pile, the method including closing a shell around a predetermined portion of a pile such that the shell forms a chamber between a length of the pile and inner surface of the shell, fixing the shell to the pile with at least one fixing member configured to substantially center the shell on the pile, sealing the shell with at least one sealing member proximate a bottom of the shell to form a substantially watertight seal at a bottom of the chamber, draining content of the shell through a drain outlet provided proximate the bottom of the shell, and spraying one or more media onto the pile with a plurality of nozzles provided inside the shell. The spraying of the one or more media may include operations such as spraying one or more cleaning agents onto the pile to remove corrosion and unwanted substances collected on the surface of the pile, flooding the chamber with liquid from outside the shell through an inlet in the shell to rinse the pile, draining the liquid rinse from the chamber through the drain outlet, spraying high-pressure air on the pile to dry the surface of the pile, spraying a protective coating on the pile to guard against future corrosion and wear, or any combination thereof.

Various example embodiments of the present general inventive concept may provide a pile maintenance system including a pile maintenance apparatus having a shell configured to be opened and closed longitudinally such that the shell forms a chamber between a length of a pile and an inner surface of the shell when the shell is closed around the pile, at least one fixing member configured to fix the shell to the pile such that the shell is substantially centered on the pile, at least one sealing member provided proximate a bottom of the shell and configured to form a substantially watertight seal at a bottom of the chamber, a plurality of nozzles provided inside the shell and configured to spray one or more media onto the pile, and a drain outlet provided proximate the bottom of the shell and configured to drain contents from the chamber formed by the shell, and a mechanical arm configured to be coupled to an outer surface of the shell and to move and to articulate opening and closing of the shell. The pile maintenance system may further include a plurality of coupling members on opposite sides of the shell and configured to couple gripping members of the mechanical arm to the shell, and a plurality of control connections extending from the pile maintenance apparatus and along the mechanical arm to a processor configured to control operations of the pile maintenance apparatus.

Various example embodiments of the present general inventive concept may provide a pile maintenance apparatus including a tank configured to be opened and closed longitudinally in an articulating fashion such that the tank may be closed about a pile, an inner surface of the tank being located a predetermined distance from an outer surface of the pile, one or more sliding members configured to move in a reciprocal fashion between positions proximate a top and bottom of the tank, a plurality of spraying nozzles coupled to the one or more sliding members, a securing member to secure the tank to the pile, a sealing member provided proximate the tank bottom to prevent water from entering the bottom of the tank, and a drain member attached to the tank to drain contents out of the tank. The spraying nozzles may include media sprayers to spray predetermined liquid substances onto the outer surface of the pile. The spraying nozzles may include air nozzles to blow compressed air onto the outer surface of the pile. The sealing member may be an inflatable bladder configured to fit around the outer surface of the pile. The tank may be configured with first and second longitudinal seams formed opposite one another, and further comprising a hinged member connecting the tank at the first seam to provide the articulating opening and closing. The pile maintenance apparatus may further include a plurality of articulating top members to at least partially close the top of the tank. The pile maintenance apparatus may further include one or more coupling members extending from an outer surface of the tank and configured to couple the tank to a crane arm. The pile maintenance apparatus may further include a plurality of rails provided longitudinally along the inner surface of the tank to which the sliding members are coupled.

Various example embodiments of the present general inventive concept may provide a method of maintaining a water platform pile, the method including opening a cylindrical tank apparatus so as to fit around the pile, securing the apparatus to the pile with one or more securing members, securing the apparatus to the pile to prevent movement of the apparatus, sealing the bottom of the tank, such as with an inflatable bladder, moving nozzles up and down the inner surface of the tank to spray various substances and/or compressed air to clean, dry, and/or coat the outer surface of the pile with a coating of a protective substance.

Various example embodiments of the present general inventive concept may provide a system including the pile maintenance apparatus described herein, a crane have an arm end that is able to be manipulated to open and place the apparatus around a pile, and to close the apparatus. The system may include various control connections as well as hoses to drain waste from the apparatus and supply liquid and/or air to a spray nozzle arrangement arranged to move in a reciprocating manner inside the tank and along a surface of the pile.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A pile maintenance apparatus, comprising:

a shell configured to be opened and closed longitudinally such that the shell forms a chamber between a length of a pile and an inner surface of the shell when the shell is closed around the pile;

at least one fixing member configured to fix the shell to the pile such that the shell is substantially centered on the pile;

at least one sealing member provided proximate a bottom of the shell and configured to form a substantially watertight seal at a bottom of the chamber;

a plurality of nozzles provided inside the shell and configured to spray one or more media onto the pile;

a drain outlet provided proximate the bottom of the shell and configured to drain contents from the chamber formed by the shell; and a base provided at the bottom of the shell, the at least one fixing member being provided in the base and comprising a plurality of cams configured to be rotatable so as to extend from the base and contact the pile.

2. The pile maintenance apparatus of claim 1, wherein the shell is formed as two sections configured to be in register with one another at respective first and second longitudinal seams when closed; and further comprising at least one hinge member coupling the two sections of the shell together proximate the first longitudinal seam;

wherein the two sections of the shell pivot about the at least one hinge member during opening and closing of the shell.

3. The pile maintenance apparatus of claim 2, further comprising at least one latching member provided proximate the second longitudinal seam and configured to secure the two sections of the shell in a closed position.

4. The pile maintenance apparatus of claim 3, wherein the at least one latching member is configured as an automatically actuating latch.

5. The pile maintenance apparatus of claim 2, further comprising at least one gasket provided along each of the first and second longitudinal seams to form a substantially watertight seal.

6. The pile maintenance apparatus of claim 1, wherein the plurality of nozzles are configured in a circle about the inner surface of the shell and to spray the one or more media in a direction toward a longitudinal center of the shell so as to spray the one or more media about a circumference of the pile.

7. The pile maintenance apparatus of claim 6, further comprising a plurality of rails provided longitudinally along the inner surface of the shell;

wherein the plurality of nozzles are configured to be moved up and down along the rails to spray the one or more media along the length of the pile in the chamber.

8. The pile maintenance apparatus of claim 7, further comprising a plurality of sliding members respectively coupled to the rails and configured to be moved up and down along the rails;

wherein two or more of the plurality of nozzles are fixed to each of the sliding members; and the sliding members are formed in an arcuate shape such that the plurality of nozzles fixed thereto are maintained at a substantially equal distance from a longitudinal center of the shell.

9. The pile maintenance apparatus of claim 8, wherein the two or more of the plurality of nozzles fixed to each of the sliding members are respectively provided in a top row and a bottom row;

one of the top or bottom rows of nozzles is configured to spray at least a first cleaning spray to clean an outer surface of the pile; and another of the top or bottom rows of nozzles is configured to spray at least a sealing substance to seal the outer surface of the pile.

10. The pile maintenance apparatus of claim 9, wherein the sealing substance is urethane.

11. The pile maintenance apparatus of claim 9, wherein at least one of the top or bottom rows of nozzles is configured to also spray compressed air to dry the outer surface of the pile.

12. The pile maintenance apparatus of claim 1, wherein the at least one sealing member comprises a plurality of air bladders configured to inflate after a closing of the shell to interact with the pile and each other to form the substantially watertight seal at the bottom of the chamber.

13. The pile maintenance apparatus of claim 1, further comprising a plurality of lid portions configured to at least partially close a top of the shell when the shell is closed.

14. The pile maintenance apparatus of claim 1, further comprising an intake port configured to pass liquid located outside the shell into the chamber.

15. A pile maintenance system, comprising:

a pile maintenance apparatus comprising:

a shell configured to be opened and closed longitudinally such that the shell forms a chamber between a length of a pile and an inner surface of the shell when the shell is closed around the pile, at least one fixing member configured to fix the shell to the pile such that the shell is substantially centered on the pile, at least one sealing member provided proximate a bottom of the shell and configured to form a substantially watertight seal at a bottom of the chamber, a plurality of nozzles provided inside the shell and configured to spray one or more media onto the pile, a drain outlet provided proximate the bottom of the shell and configured to drain contents from the chamber formed by the shell, and a base provided at the bottom of the shell, the at least one fixing member being provided in the base and comprising a plurality of cams configured to be rotatable so as to extend from the base and contact the pile; and a mechanical arm configured to be coupled to an outer surface of the shell and to move and to articulate opening and closing of the shell.

16. The pile maintenance system of claim 15, further comprising:

a plurality of coupling members on opposite sides of the shell and configured to couple gripping members of the mechanical arm to the shell; and a plurality of control connections extending from the pile maintenance apparatus and along the mechanical arm to a processor configured to control operations of the pile maintenance apparatus.

17. A pile maintenance apparatus, comprising:

a shell configured to be opened and closed longitudinally such that the shell forms a chamber between a length of a pile and an inner surface of the shell when the shell is closed around the pile;

at least one fixing member configured to fix the shell to the pile such that the shell is substantially centered on the pile;

at least one sealing member provided proximate a bottom of the shell and configured to form a substantially watertight seal at a bottom of the chamber;

a plurality of nozzles provided inside the shell and configured to spray one or more media onto the pile, the plurality of nozzles being configured in a circle about the inner surface of the shell and to spray the one or more media in a direction toward a longitudinal center of the shell so as to spray the one or more media about a circumference of the pile;

a plurality of rails provided longitudinally along the inner surface of the shell, the plurality of nozzles being configured to be moved up and down along the rails to spray the one or more media along the length of the pile in the chamber;

a plurality of sliding members respectively coupled to the rails and configured to be moved up and down along the rails, two or more of the plurality of nozzles being fixed to each of the sliding members, and the sliding members being formed in an arcuate shape such that the plurality of nozzles fixed thereto are maintained at a substantially equal distance from a longitudinal center of the shell; and a drain outlet provided proximate the bottom of the shell and configured to drain contents from the chamber formed by the shell.

18. The pile maintenance apparatus of claim 17, wherein the two or more of the plurality of nozzles fixed to each of the sliding members are respectively provided in a top row and a bottom row;

one of the top or bottom rows of nozzles is configured to spray at least a first cleaning spray to clean an outer surface of the pile; and another of the top or bottom rows of nozzles is configured to spray at least a sealing substance to seal the outer surface of the pile.

19. The pile maintenance apparatus of claim 18, wherein the sealing substance is urethane.

20. The pile maintenance apparatus of claim 18, wherein at least one of the top or bottom rows of nozzles is configured to also spray compressed air to dry the outer surface of the pile.

* * * * *